US009072935B2

(12) United States Patent
Ross

(10) Patent No.: US 9,072,935 B2
(45) Date of Patent: Jul. 7, 2015

(54) WEIGHTED VEST

(71) Applicant: Exemplar Design, LLC, Mason, OH (US)

(72) Inventor: Adam L. Ross, West Chester, OH (US)

(73) Assignee: Exemplar Design, LLC, Mason, OH (US)

( * ) Notice: Subject to any disclaimer, the term of this patent is extended or adjusted under 35 U.S.C. 154(b) by 345 days.

(21) Appl. No.: 13/750,492

(22) Filed: Jan. 25, 2013

(65) Prior Publication Data

US 2013/0190144 A1 Jul. 25, 2013

Related U.S. Application Data

(60) Provisional application No. 61/590,397, filed on Jan. 25, 2012.

(51) Int. Cl.

| | |
|---|---|
| ***A63B 21/065*** | (2006.01) |
| ***A63B 21/06*** | (2006.01) |
| ***A63B 21/00*** | (2006.01) |
| ***A63B 23/04*** | (2006.01) |

(52) U.S. Cl.

CPC ..... *A63B 21/065* (2013.01); *A63B 21/0603* (2013.01); *A63B 21/1415* (2013.01); *A63B 23/047* (2013.01)

(58) Field of Classification Search

CPC .... A63B 21/14; A63B 21/1403; A63B 21/06; A63B 21/065

USPC ..... 482/92, 93, 105, 148; 2/69, 92, 102, 2/462

See application file for complete search history.

(56) References Cited

U.S. PATENT DOCUMENTS

| | | | | |
|---|---|---|---|---|
| 4,268,917 | A | 5/1981 | Massey | |
| 4,394,012 | A * | 7/1983 | Egbert et al. | 482/105 |
| D278,840 | S | 5/1985 | Winston | |
| D340,794 | S | 11/1993 | Winston | |
| 5,361,412 | A * | 11/1994 | Perry | 2/69 |
| D390,338 | S | 2/1998 | Plasco | |
| 6,081,924 | A * | 7/2000 | Ott | 2/102 |
| 6,669,608 | B1 | 12/2003 | Winston | |
| D645,209 | S | 9/2011 | Lin | |
| 8,262,545 | B1 | 9/2012 | Beber et al. | |
| 2006/0090240 | A1 | 5/2006 | McKenzie et al. | |

(Continued)

OTHER PUBLICATIONS

Everlast EverGrip Strength Weighted Vest advertised by Walmart—http://www.walmart.com/ip/Everlast-EverGrip-Weighted-Vest/23377610?action=product_. . . [Date retrieved—Sep. 17, 2013].

(Continued)

*Primary Examiner* — Loan H Thanh
*Assistant Examiner* — Nyca T Nguyen
(74) *Attorney, Agent, or Firm* — Baker & Hostetler LLP

(57) ABSTRACT

A sports vest for fitness training provides body-centered resistance for endurance, agility, and strength training. The vest has a V-shaped front neoprene panel, and a generally identical back neoprene panel. A plurality of auxiliary pockets holds weights along the legs of the each panel. A triangular central pocket hold weights just above the rounded V point on each panel. Interior partitions within the pockets prevent the weights from shifting. Straps secure the vest to a fitness trainee. The vest shape, arrangement of weights, and weight partitions generally maintains a trainee's center of gravity and balance in executing exercise movements.

20 Claims, 4 Drawing Sheets

(56) References Cited

U.S. PATENT DOCUMENTS

| | | | | |
|---|---|---|---|---|
| 2012/0002403 | A1 * | 1/2012 | Winzer et al. | 362/108 |
| 2012/0289385 | A1 | 11/2012 | Marji | |

OTHER PUBLICATIONS

Gold's Gym 12-lb. Weighted Vest advertised by Walmart—http://www.walmart.com/ip/Gold-s-Gym-12-lb.-Weighted-Vest/14894527?action=product . . . [Date retrieved—Sep. 17, 2013].

Gold's Gym 20 lbs. Adjustable Weighted Vest advertised by Walmart—http://www.walmart.com/ip/Gold-s-Gym-20-lbs.-Adjustable-Weighted-Vest/5481392 [Date retrieved—Sep. 17, 2013].

Hammer Strength Training Vest advertised by Life Fitness—http://www.lifefitnessgymequipment.co.za/product-classification/commercial-strength/hammer-strength.html [Date retrieved—Sep. 17, 2013].

10 lb. Hyper Vest Pro Unisex Adjustable Weighted Vest advertised by Hyperwear—http://www.hyperwear.com/all-products/hyper-vest-pro-adjustable-weight-vest.html#ad-image-0 [Date retrieved—Sep. 17, 2013].

MiR Weighted Vest—Fitness Exercise Weight Vest from 10 lbs—200 lbs advertised by Mir Weighted Vest—http:mirweightedvest.com/ [Date retrieved—Sep. 17, 2013].

UFC Weighted Vest advertised by Walmart—http://www.walmart.com/ip/UFC-Weighted-Vest/15084487?action=product_interest&acti . . . [Date retrieved—Sep. 17, 2013].

* cited by examiner

WEIGHTED VEST

CROSS-REFERENCE TO RELATED APPLICATIONS

This application claims the benefit of U.S. Provisional Application No. 61/590,397, titled "Weighted Vest," filed Jan. 25, 2012, which is hereby incorporated by reference.

FIELD OF THE INVENTION

This device pertains to the physical therapy, sports and fitness, and exercise field; and the garment field.

BACKGROUND

The device of the present disclosure generally pertains to fitness equipment and sports training devices, and particularly to a vest worn by a user for strength and endurance training.

Weighted vests provide weight on a user during general fitness exercise, and speed and agility training, to provide resistance and develop a user's endurance, power and strength. Some weighted vests allow for adjustable weights. Weighted vests may be manufactured in various sizes and shapes, with some weighted vests being adjustable for a user's size using hook and loop closures. Some weighted vests fit similar to a normal vest, i.e. shaped like a normal shirt without sleeves. However these designs do not provide optimal balance and weight distribution when the vest is worn. This unnatural distribution may lead to awkward or unnatural movements by the user to compensate for weight shifting and improper weight distribution.

SUMMARY

The current disclosure solves the problem of balance and weight distribution in a weighted vest during exercise, such as those exercises involving forward and lateral movements and quick direction changes. The user gains the cardiovascular and fitness benefits of additional weight and resistance in a stable and balanced distribution, and without problems such as weight shifting, awkward weight distribution, and inertial imbalances, so the user may perform natural movements during exercise. Specifically, the shape of the vest, and placement of the weights, provides a body-centered weighted vest to maintain the natural balance and center of gravity of a user, even during exercise movements.

Further, the vest, and weights within the vest resists lateral movement relative to the user's body.

The vest of the current disclosure is a weighted exercise vest which may be used in multiple fields as a fitness accessory, allowing the user to exercise with natural movements.

Wearable fitness and resistance devices are generally disclosed. Some example embodiments may include methods, apparatus, and/or systems pertaining to weighted vests.

Some example weighted vests according to at least some aspects of the present disclosure may include pre-measured weights, or user-determined weights.

An adjustable sports training vest capable of fitting users of variable sizes includes a front panel and a back panel in generally identical V-shapes. The front panel and the back panel are joined together along the top of each V to form shoulder straps. The front panel and the back panel of the vest tapers to a rounded point, to form the generally V shape of each panel, which extends towards a user's center of gravity.

A breathable central panel, or bib, partially fills the interior of the front panel and back panel.

A plurality of auxiliary pockets are distributed along the sides of the front panel and the back panel to hold weights. A larger, triangular pocket may be located on midline of the front panel and the midline of the back panel, proximate the rounded V point, and is adapted for holding weights.

A plurality of straps are connected to the front panel, and are releasably attachable either to itself, or to a plurality of corresponding straps connected to the back panel.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

In the drawings.

DETAILED DESCRIPTION

Figure 1A:
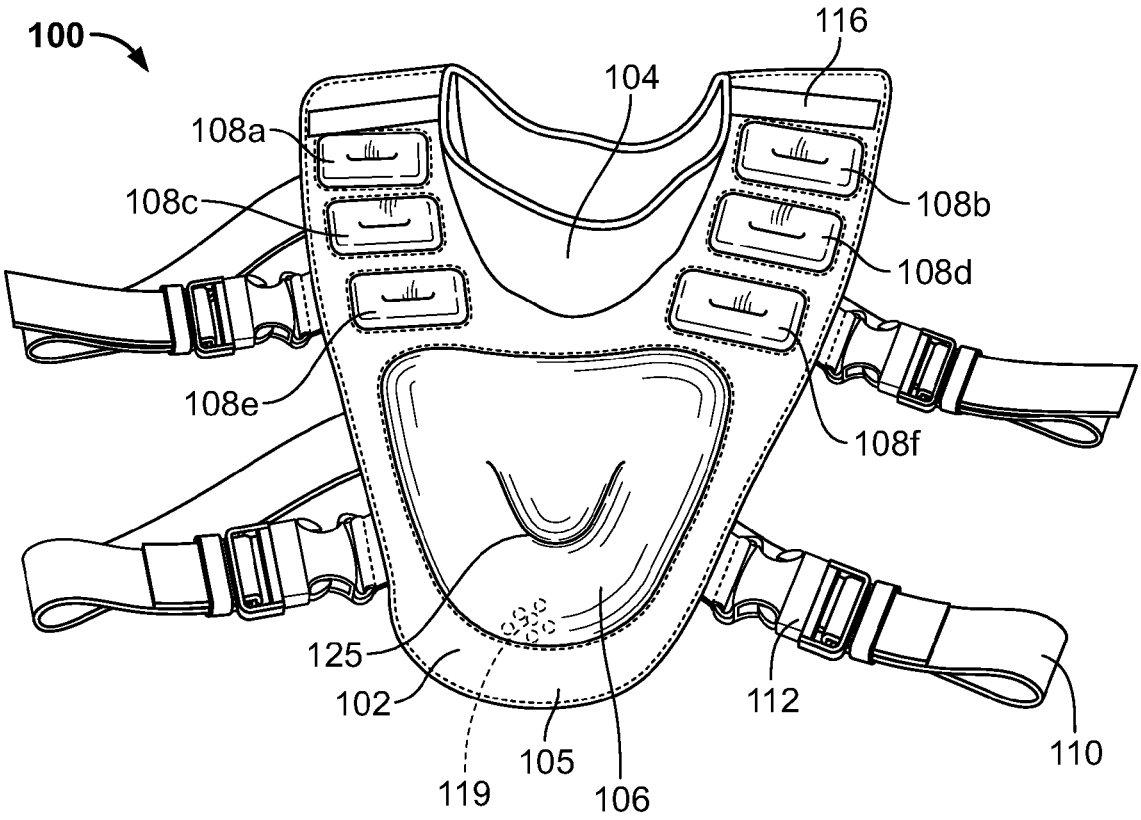
FIG. 1A is a perspective view of an exemplary embodiment of the fitness training device.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be used, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and make part of this disclosure.

Methods, systems, devices, and/or apparatus related to wearable fitness devices and weights are disclosed.

Referring to FIG. 1A, a first illustrative embodiment of a fitness training device or vest 100 is shown. Main body of fitness training device 100 is a V-shaped panel 102 which supports a plurality of weights 109 closely to a trainee or user (shown in FIG. 4) without deforming or tearing. Thus, an exemplary material for V panel 102 of vest 100 is neoprene, which is firm, strong, and flexible. The right side and the left side of the V panel 102 stretches diagonally across a user's body and meets to form a rounded V point 105. A stretchy, generally triangular panel or bib 104 partially fills in the space between V panel 102, and attaches to vest 100 at the inner edges of V panel 102. Bib 104 holds the legs of V panel 102 at a constant distance to prevent V panel 102 from separating and slipping off a user. Bib 104 dips or arcs down at the center to conform to the user's chest and provide room for the user's neck. Bib 104 may be made from a stretchy and moisture wicking material such as microfiber.

Figure 1B:
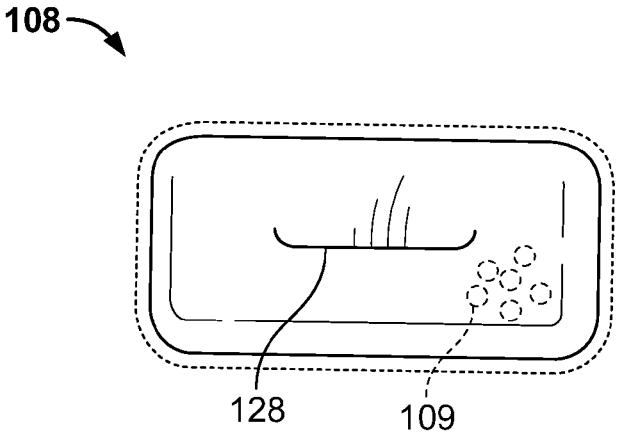
FIG. 1B shows an exemplary embodiment of a weight pocket in enlarged detail.

Vest 100 includes a plurality of auxiliary pockets. FIG. 1A illustrates six pockets 108*a*-108*f*, three on the right side 108*a*, 108*c*, 108*e*; and three on the left side 108*b*, 108*d*, 108*f* of V panel 102; as shown in FIG. 1B, each pocket 108 is adapted hold a weight 109. Weights 109 may be composed of graduations of steel pellets, metal grains or sand, and may be weighted or measured, sealed in impermeable bags, and inserted into auxiliary pockets 108*a*-108*f*. Auxiliary pockets 108*a*-108*f* may be integrated in the V panel 102, or sewn onto V panel 102. A tack 128 composed of several sturdy stitches sewn through the center of each auxiliary pocket 108*a*-108*f* creates a partial wall mid-way across each pocket 108*a*-108*f*.

As shown in FIG. 1B, tack 128 serves as an enforcement structure to provide support for a portion of weight 109. Further, tack 128 divides the weight so weight 109 is evenly distributed across pocket 108, and prevents weight 109 from shifting during movement. Thus, tack 128 prevents weight 109 from pooling to one side, or along the bottom of pocket 108, and helps pocket 108 resist stretching.

FIG. 1A shows a central pocket 106 centered on the midline of V panel 102 contains a weight 119. In some embodiments, central pocket 106 may be an inverted triangle generally concentric to V-panel 102. Central pocket 106 may contain "V" shaped stitching 125, which would serve the same function as tack 128. Additional partial partitions and stitching 125 may be placed within the interior of central pocket 106.

In the embodiment shown in FIG. 1B, the perimeter of each auxiliary pocket 108 and central pocket 106 is sewn, glued, or otherwise sealed so the pockets 108 are not accessible in this embodiment. In this embodiment, weight 109 is sized to perfectly fill auxiliary pocket 108 and central pocket 106 so there is no space for weight 109 to move.

In the embodiment of FIG. 1A, each auxiliary pocket 108*a*-108*f* is generally centered with respect to the left and right side of the legs on V panel 102. Because of the V-shape of panel 102, each lower (lower defined as closer to point 105) auxiliary pocket 108 also lies closer to the center line than the auxiliary pocket 108 above it. This arrangement of the auxiliary pockets 108*a*-108*f*, and the V shape of central pocket 106 aligns the weights' 109 center of gravity with the user's (see FIG. 4) center of gravity. In some embodiments, vest 100 has a vertical length which does not extend past a user's center of gravity so the weight is focused towards, and not beyond, the user's center of gravity.

Reflective strip or strips 116 may be glued, sewn, or otherwise affixed to body 102 to add visibility to the user during low light or night time exercises. Straps 110, including releasably attachable mechanism 112 such as a buckle, may attach to each side of panel 102 for securing vest 100 to a user.

Figure 2A:
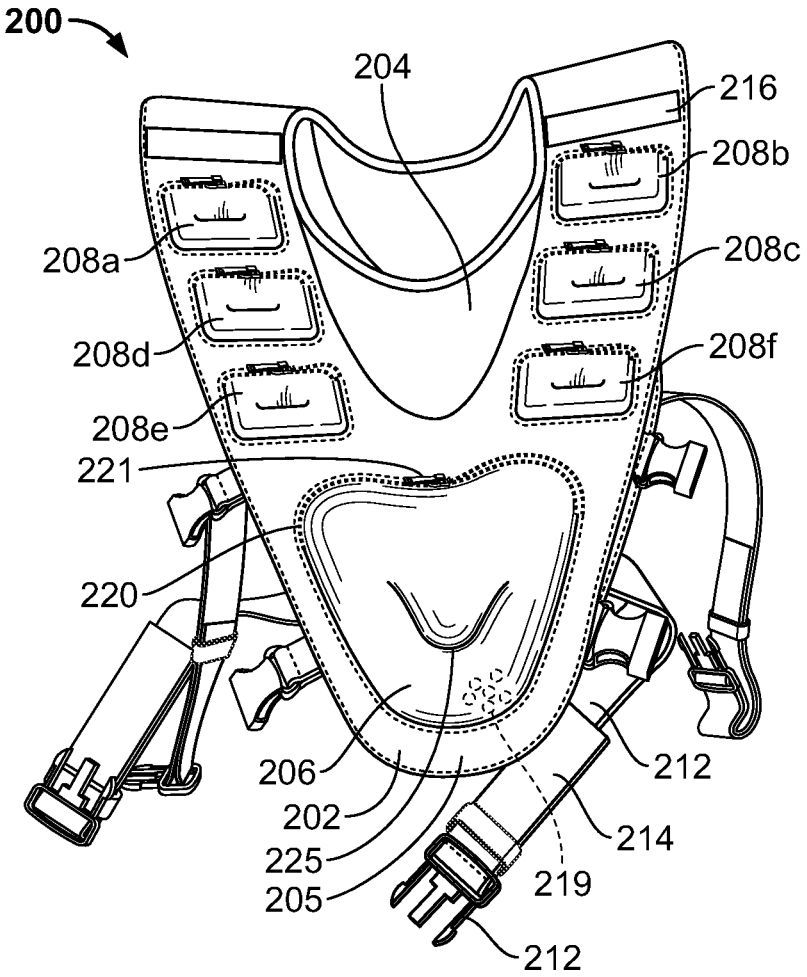
FIG. 2A is a perspective view of an alternate embodiment of the fitness training device.
Figure 2B:
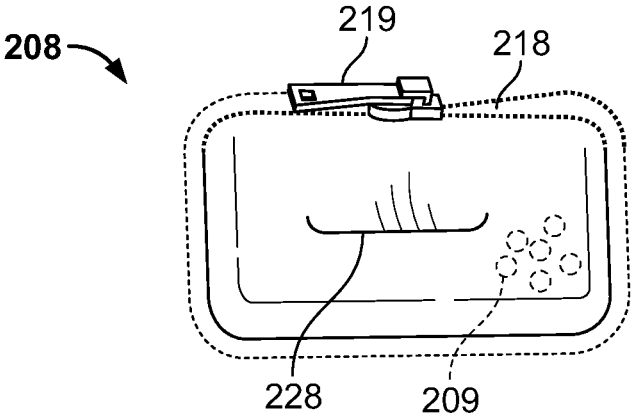
FIG. 2B shows an exemplary embodiment of a weight pocket in enlarged detail.

In an alternate embodiment shown in FIG. 2A, fitness training device 200 includes auxiliary pockets 208*a*-208*f* which may be accessed through respective access points 218 shown in FIG. 2B, such as a slot. Access points 218 may be sealed with a zipper, a continuous plastic sealing lock, or other closure 219, to remove and replace weight 219 with a heavier or lighter weight 219. Central pocket 206 includes corresponding access point 220 and sealing closure 221. Preferably, closures 219 and 221 seals continuously along the entire access point 218 and 220 to ensure even pressure along all sides of pockets 208 and 206, and so weight 209 does not shift to an area of decreased pressure, and is not able to slip out through access point 218. At least a portion of the outer side of auxiliary pocket 208 and central pocket 206 may be fabricated from a resilient, stretchy material, to accommodate and tightly conform to various weight sizes 209 and 219. Weights 209 and 219 may be measured or weighed, placed in bags 532 (shown in FIG. 5) to avoid spillage, and then inserted into pocket 206 or 208. Bags 532 may be measured each time weight 209, 219 is changed, or the bags 532 may be pre-measured and ready to be inserted into pockets 206, 208 on vest 200.

Figure 3B:
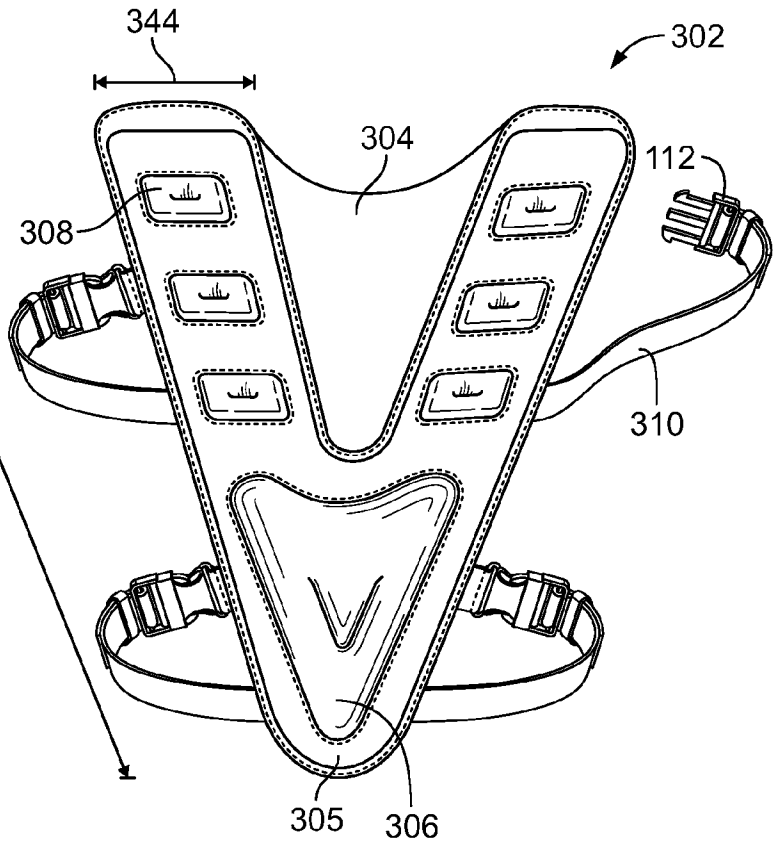
FIG. 3 (*a*) shows the front (*b*) shows the back of an exemplary embodiment of the fitness training device.
Figure 3A:
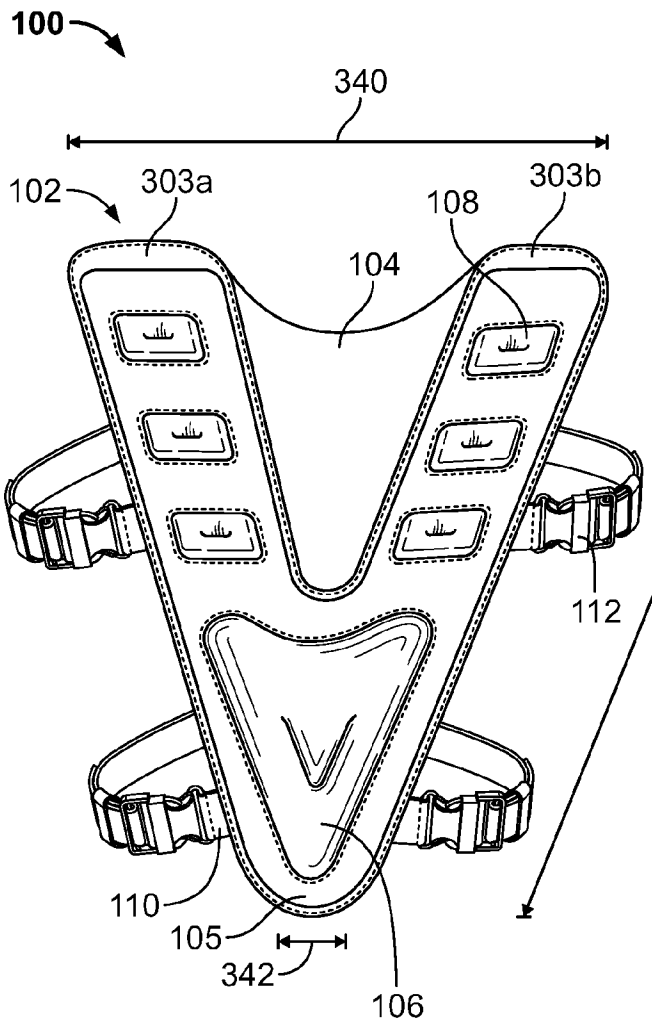

FIG. 3(*a*) and FIG. 3(*b*) illustrates an exemplary embodiment of vest 100. FIG. 3(*a*) depicts the front section 102 of vest 100, and FIG. 3(*b*) depicts a generally identical back section 302 of vest 100. Back section 302 contains a similar identical configuration including a central pocket 306 and auxiliary pockets 308. Front section 102 and back section 302 are joined together at the top of the V, forming shoulder straps 303*a* and 303*b*. Front section 102 and back section 302 may be sewn together.

A set of straps 110 attach to each side of front panel 102. In some embodiments, front straps 110 may attach to a set of corresponding straps 310 attached to each side of back panel 302, via a releasably attachable mechanism 112 such as a squeeze release buckle or clip, to allow front straps 110 and back straps 310 to connect, as well as completely separate. In alternate embodiments, straps 110 may be an adjustable belt, passing through belt loops on front panel 102 and back panel 302. Straps 110 and 310 may be fabricated from a tough, non-stretch and water resistant webbing such as nylon. The embodiment of FIGS. 3(*a*) and 3(*b*) illustrates two sets of straps 110 and 310 on each side, but there may be any number of strap sets 110 and 310 to securely fasten vest 100 to a user.

Exemplary dimensions of vest 100 may be as shown in FIG. 3. As shown in FIG. 3(*a*), the width 340 of vest 300 from the leftmost side to the right most side may be approximately 18-19." Vest 100 may be approximately 18" along each diagonal length 342, extending from where the front panel 102 and back panel 302 are joined, to either the front V tip 105 or the back V tip 305. V tip 105 and 305 are rounded to resist folding, as the gradual arc provides lateral support. The width 342 at the point where V tip 105 and 305 each begins to round may be approximately 4". As shown in FIG. 3(*b*), the thickness/width 344 of each diagonal forming shoulder strap 303*a* and 303*b*, may be approximately 4". These measurements are not to be taken as absolute, but only as exemplary measurements which may work for an exemplary vest 100, to suit users of average size.

Exemplary weight 109 units for vest 100 may be as follows. For a weighted vest 100 of ten pounds, the weights 109 in each of the six auxiliary pockets 108*a*-108*f* on both the front section 102 and 308*a*-308*f* on back section 302 would be approximately half a pound, for a total of 6 pounds. The central pocket 106 on the front section 102 and 306 on back section 302 would each contain two pounds, for another four pounds, and a total of ten pounds. Multiple selections of weight may be provided depending upon the application and desire of the user.

Figure 4:
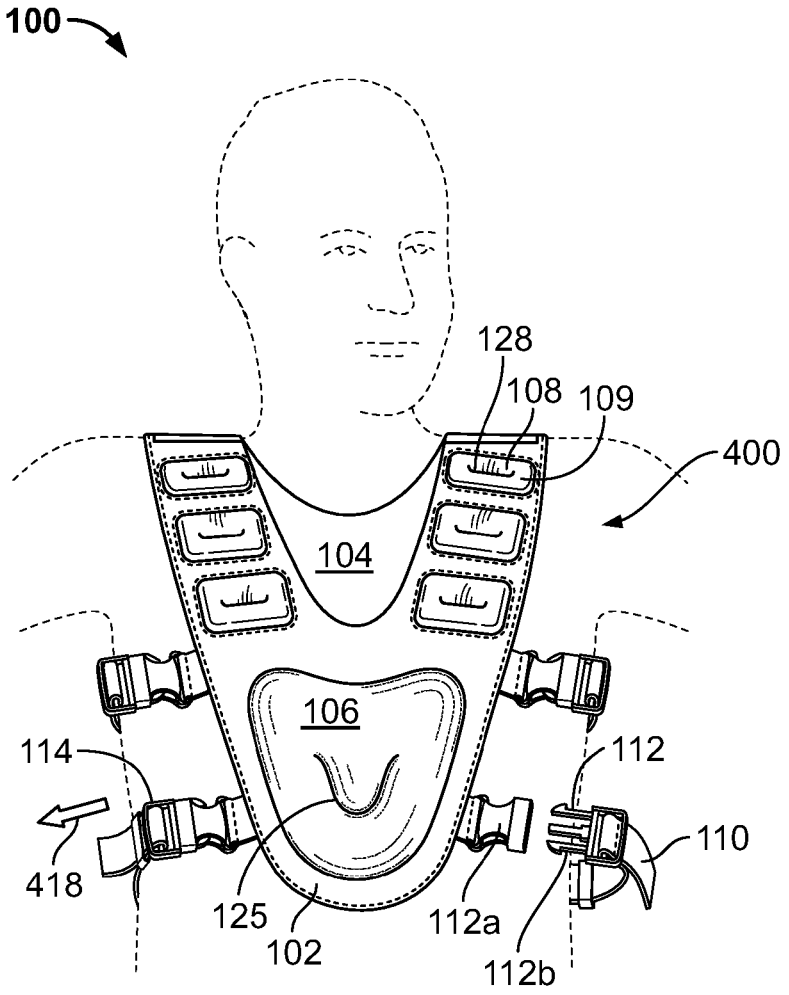
FIG. 4 illustrates an exemplary embodiment of the fitness device as it may be worn by a fitness trainee.

FIG. 4 illustrates vest 100 as it would be worn by a user 400. Straps 110 may be loosened with an adjuster 114 such as a friction buckle for adjusting the length of straps 110, and straps 110 may be separated from its corresponding strap (either the other end of 110, or from 310) before user 400 dons vest 100. Vest 100 is draped over the torso of user 400, and secured to user 400 by connecting or buckling the each corresponding straps 110 by with clips 112, and engaging 112*a* female and 112*b* male clips. Friction adjuster 114 allows for adjustability of the strap 110 to conform to a user's torso.

Straps 110 may be tightened by pulling in direction 418 where strap 110 extends from adjuster 114 so the vest 100 fits snugly around user 400's chest and torso area. As described above and shown in FIG. 4, vest 100 covers the upper torso of user 100 but vest 100 does not extend below user 400's center of gravity, to focus the weight towards, but not beyond, the user 400's center of gravity. This force allows the user to move naturally. The tightly stretched pockets 108 and stitched partial partitions 125 and tacks 128 ensures weight 109 remains immobile to avoid inertial imbalances of vest 100 against user 400 movement.

Figure 5:
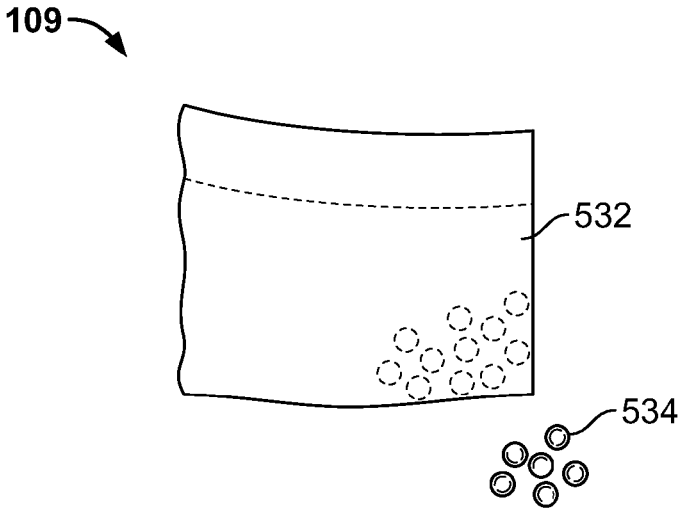
FIG. 5 is an exemplary interior weight within a fitness training device.

FIG. 5 illustrates example weights 109 such as steel sand or pellets 534, which provides graduated weight settings. Pellets 534 may be directly inserted into each pocket 108 and 106; or pellets 534 may be filled in a non-permeable (with respect to the pellets) bag 532 prior to being placed in pocket 108 or 106. In some embodiments, stitches of partitions 125 or tack 128 may pass through bag 532; in other embodiments, bag 532 may be an elongated tube or otherwise shaped to encircle the space within the pocket 108 and 106.

What is claimed is:

1. A sports training vest comprising:

a front panel and back panel, each panel comprising a top, a bottom, and legs, said front panel and said back panel are joined together approximate the top of each panel, the panels being generally similar V-shapes and taper to a rounded V-point at the bottom of each panel;

a bib partially filling space between the legs of at least one of the panels;

a plurality of auxiliary pockets adapted to hold weights, distributed along the legs of each panel;

a central pocket on each panel adapted to hold weights; and a plurality of adjustable straps with releasably attachable buckles, attached to the front panel.

2. The sports training vest of claim 1, wherein:

the central and auxiliary pockets each contain a weight; and the pockets are sealed from all sides.

3. The sports training vest of claim 2, wherein:

the weight within each auxiliary pocket is approximately half a pound; and the weight in each central pocket is approximately two pounds.

4. The sports training vest of claim 1, wherein the weights include at least one of metal grains, steel pellets, and sand.

5. The sports training vest of claim 4, further comprising a non-permeable bag to contain the weights.

6. The sports training vest of claim 1, wherein:

the plurality of adjustable straps are releasably attachable to a plurality of corresponding straps attached to the back panel.

7. The sports training vest of claim 1, further including:

at least one reflective strip affixed to the vest.

8. The sports training vest of claim 1, wherein:

the panels are made from neoprene.

9. The sports training vest of claim 1, wherein said bib is located on the front panel and the back panel comprises a second bib, the bib of the front panel does not connect to the second bib of the back panel.

10. The sports training vest of claim 1, wherein:

the bib is made from microfiber.

11. The sports training vest of claim 1, wherein:

the plurality of pockets each include an access point to the pocket, wherein the access points may be opened and sealed.

12. The sports training vest of claim 11, wherein:

each pocket stretches to tightly accommodate a weight.

13. The sports training vest of claim 1, wherein:

the central pockets are triangular and generally concentric to the rounded V.

14. The sports training vest of claim 1, further comprising:

a partial separation stitched within the central pockets and each of the plurality of auxiliary pockets.

15. The sports training vest of claim 1, wherein:

the plurality of auxiliary pockets are symmetrically distributed on the left and right side of each panel.

16. The sports training vest of claim 1, wherein:

the vest is approximately 18-19" wide along the top of the panels;

the width of each right and left V leg is approximately 4"; and each panel approximately 18" along the diagonal.

17. A sports training vest comprising:

a front neoprene panel and a back neoprene panel each panel comprising a top, a bottom, and legs, said front panel and said back panel are joined together at the top of each panel, wherein each panel downwardly tapers to a round V-point at the bottom;

a microfiber bib partially filling a space between upwardly extending legs of each panel;

a plurality of auxiliary pockets adapted to hold weights distributed along the legs of each panel, a central pocket adapted to hold weights located just above the rounded V point on each panel;

a partial separation stitched within each of the central and auxiliary pockets;

the weights are either metal grains, steel pellets, or sand, in non-permeable bags; and a plurality of adjustable straps, including releasably attached buckles, attached to the front panel.

18. The sports training vest of claim 17, wherein:

the central and auxiliary pockets each contain a weight; and the pockets are sealed from all sides.

19. The sports training vest of claim 17, further comprising:

the plurality of pockets each include an access point to the pocket, wherein the access point may be opened and sealed.

20. The sports training vest of claim 17, wherein:

the vest is approximately 18-19" wide;

the width of each leg is approximately 4"; and each panel approximately 18" along the diagonal.

* * * * *